US008079915B2

(12) United States Patent
Spencer et al.

(10) Patent No.: US 8,079,915 B2
(45) Date of Patent: Dec. 20, 2011

(54) PLAYGROUND EQUIPMENT

(75) Inventors: Don Spencer, Ogden, UT (US); Jacob Kearl, Plain City, UT (US); Carl R. Stanford, Clearfield, UT (US)

(73) Assignee: Lifetime Products, Inc., Clearfield, UT (US)

( * ) Notice: Subject to any disclaimer, the term of this patent is extended or adjusted under 35 U.S.C. 154(b) by 190 days.

(21) Appl. No.: 12/506,442

(22) Filed: Jul. 21, 2009

(65) Prior Publication Data

US 2010/0012795 A1 Jan. 21, 2010

Related U.S. Application Data

(60) Provisional application No. 61/138,399, filed on Dec. 17, 2008, provisional application No. 61/117,517, filed on Nov. 24, 2008, provisional application No. 61/082,454, filed on Jul. 21, 2008.

(51) Int. Cl.
*A63G 9/12* (2006.01)
*A63G 9/00* (2006.01)

(52) U.S. Cl. ..... 472/118; 473/479

(58) Field of Classification Search ..... 472/116, 472/117, 128, 136; 473/479–483
See application file for complete search history.

(56) References Cited

U.S. PATENT DOCUMENTS

| | | | | |
|---|---|---|---|---|
| 1,466,031 | A | | 8/1923 | Rippin |
| 1,845,832 | A | | 2/1932 | Cottner |
| 2,151,403 | A | | 3/1939 | Burke |
| D160,320 | S | | 10/1950 | Horowitz |
| D165,593 | S | | 1/1952 | Low |
| D191,749 | S | | 11/1961 | Haubert |
| D194,214 | S | | 12/1962 | Shepard |
| D195,633 | S | | 7/1963 | Haubert |
| D200,478 | S | | 3/1965 | Haubert |
| D212,193 | S | | 9/1968 | Rudy |
| 3,516,659 | A | | 6/1970 | Kleid |
| 3,656,581 | A | | 4/1972 | Larson |
| D223,674 | S | | 5/1972 | Johnson |
| D225,072 | S | | 11/1972 | Henning et al. |
| D225,073 | S | | 11/1972 | Henning et al. |
| D226,318 | S | | 2/1973 | Henning et al. |
| D236,276 | S | | 8/1975 | Rudy |
| D238,888 | S | | 2/1976 | Bradley |
| D241,664 | S | | 9/1976 | Ewers |
| 3,990,667 | A | * | 11/1976 | Tomalinas, Jr. ..... 248/370 |
| D257,165 | S | | 9/1980 | Ezell |
| D257,875 | S | | 1/1981 | Rudy |

(Continued)

OTHER PUBLICATIONS

U.S. Appl. No. 60/688,551, filed Jun. 7, 2005, Nye.

(Continued)

*Primary Examiner* — Kien Nguyen
(74) *Attorney, Agent, or Firm* — Workman Nydegger

(57) ABSTRACT

A support member for playground equipment may include a first section with a flared end and a second section with a tapered end. An opening may be disposed in the flared end of the first section and an elongated slot may be disposed in the tapered end of the second section. When the tapered and flared ends are initially connected, the openings may be aligned and a fastener may be inserted into the aligned openings. When the tapered and flared ends are forced together and overlap a greater amount, which may create a more secure connection, the fastener may help keep in the first and second sections in alignment and may help prevent unintended rotational movement of the first and second sections.

22 Claims, 13 Drawing Sheets

U.S. PATENT DOCUMENTS

| | | | | |
|---|---|---|---|---|
| D281,893 | S | 12/1985 | Addleman | |
| 4,579,708 | A | 4/1986 | Rosart | |
| 4,761,981 | A | 8/1988 | Kelly | |
| 4,941,658 | A | 7/1990 | Poo | |
| 4,966,309 | A | 10/1990 | Baer | |
| 5,016,873 | A | 5/1991 | Bossa | |
| 5,110,375 | A | 5/1992 | Parsons | |
| 5,203,752 | A | 4/1993 | Frankel | |
| 5,364,312 | A | 11/1994 | Cunard et al. | |
| D366,923 | S | 2/1996 | Boifava | |
| 5,554,074 | A | 9/1996 | Von Parrish | |
| D376,186 | S | 12/1996 | Penney | |
| 5,709,247 | A | 1/1998 | Hutton | |
| D406,320 | S | 3/1999 | Lynch et al. | |
| 5,967,901 | A | 10/1999 | Briggs | |
| 6,083,205 | A | 7/2000 | Bourne et al. | |
| 6,116,888 | A | 9/2000 | Johnston | |
| D446,570 | S | 8/2001 | Kjaer-Madsen et al. | |
| 6,302,801 | B1 | 10/2001 | Zeilinger | |
| 6,427,403 | B1 | 8/2002 | Tambakis | |
| 6,482,095 | B2 | 11/2002 | Zeilinger | |
| D468,386 | S | 1/2003 | Frank | |
| 6,527,645 | B1 | 3/2003 | Cline | |
| D479,569 | S | 9/2003 | Van Deusen | |
| D481,094 | S | 10/2003 | Van Deusen | |
| D481,095 | S | 10/2003 | Van Deusen | |
| D481,779 | S | 11/2003 | Van Deusen | |
| D495,376 | S | 8/2004 | Zee | |
| 6,994,502 | B2 | 2/2006 | Winter et al. | |
| 6,994,655 | B2 * | 2/2006 | Chu | 482/38 |
| D520,520 | S | 5/2006 | Nimberger | |
| 7,060,002 | B1 | 6/2006 | Boehme | |
| D524,895 | S | 7/2006 | VanDuesen et al. | |
| 7,094,189 | B2 | 8/2006 | Fallacaro | |
| D534,984 | S | 1/2007 | Nye | |
| D536,406 | S | 2/2007 | Nye | |
| D536,407 | S | 2/2007 | Nye | |
| D536,408 | S | 2/2007 | Nye | |
| D536,409 | S | 2/2007 | Nye | |
| D536,410 | S | 2/2007 | Nye | |
| D536,411 | S | 2/2007 | Nye | |
| D536,412 | S | 2/2007 | Nye | |
| D538,878 | S | 3/2007 | Kearl | |
| 7,186,183 | B2 | 3/2007 | Zellinger | |
| D543,494 | S | 5/2007 | Hall | |
| D544,549 | S | 6/2007 | Glatz | |
| 7,225,832 | B2 | 6/2007 | Stamler | |
| 7,235,019 | B1 | 6/2007 | LeCher | |
| D550,320 | S | 9/2007 | Nye | |
| D560,740 | S | 1/2008 | Phelps | |
| D575,840 | S | 8/2008 | Sammann et al. | |
| D587,776 | S | 3/2009 | Robertson | |
| D593,179 | S | 5/2009 | Kearl et al. | |
| D602,554 | S | 10/2009 | Kearl et al. | |
| D604,790 | S | 11/2009 | Kearl et al. | |
| 7,803,071 | B2 * | 9/2010 | Stanford et al. | 473/479 |
| 7,837,569 | B2 * | 11/2010 | Ouellet | 472/118 |
| 2001/0040003 | A1 | 11/2001 | Yang | |
| 2004/0063507 | A1 | 4/2004 | Henderson et al. | |
| 2004/0224823 | A1 | 11/2004 | Myers | |
| 2005/0176557 | A1 | 8/2005 | Bork | |
| 2005/0233862 | A1 | 10/2005 | Madigan | |
| 2006/0079379 | A1 | 4/2006 | Zellinger | |
| 2007/0117494 | A1 | 5/2007 | Sheller | |
| 2008/0026881 | A1 | 1/2008 | Stanford et al. | |

OTHER PUBLICATIONS

U.S. Appl. No. 60/729,625, filed Oct. 24, 2005, Nye.
U.S. Appl. No. 11/447,334, filed Jun. 6, 2006, Nye.
U.S. Appl. No. 29/265,012, filed Aug. 23, 2006, Phelps.
U.S. Appl. No. 29/265,024, filed Aug. 23, 2006, Phelps.
U.S. Appl. No. 60/839,559, filed Aug. 23, 2006, Hamblin.
U.S. Appl. No. 60/941,248, filed May 31, 2007, Nye.
U.S. Appl. No. 11/844,147, filed Aug. 23, 2007, Hamblin.
U.S. Appl. No. 61/037,228, filed Mar. 17, 2008, Nye.
U.S. Appl. No. 61/037,234, filed Mar. 17, 2008, Nye.
U.S. Appl. No. 12/129,107, filed May 29, 2008, Nye.
U.S. Appl. No. 29/318,958, filed May 31, 2008, Kearl.
U.S. Appl. No. 29/318,956, filed May 31, 2008, Kearl.
U.S. Appl. No. 29/318,955, filed May 31, 2008, Kearl.
U.S. Appl. No. 61/082,454, filed Jul. 21, 2008, Spencer.
U.S. Appl. No. 29/330,175, filed Dec. 30, 2008, Nye.
U.S. Appl. No. 29/340,676, filed Jul. 23, 2009, Kearl.
U.S. Appl. No. 12/605,982, filed Oct. 26, 2009, Spencer.
International Search Report and Written Opinion from PCT International Application No. PCT/2006/022068, dated Jun. 25, 2008.
International Preliminary Report on Patentability from PCT International Application No. PCT/2006/022068, dated May 5, 2009.
Office Action dated Jun. 24, 2008 from U.S. Appl. No. 11/447,334.
Office Action dated Feb. 10, 2009 from U.S. Appl. No. 11/844,147.
Office Action dated May 13, 2009 from U.S. Appl. No. 11,447,334.
Notice of Allowability dated Jun. 3, 2009 from U.S. Appl. No. 29/318,957.
Notice of Allowability dated Jul. 28, 2009 from U.S. Appl. No. 29/318,958.
Office Action dated Jan. 20, 2010 from U.S. Appl. No. 11/447,334.
U.S. Appl. No. 12/605,982, mail date May 15, 2011, Office Action.

* cited by examiner

PLAYGROUND EQUIPMENT

CROSS-REFERENCE TO RELATED APPLICATIONS

The present application claims priority to and the benefit of U.S. Provisional Patent Application Ser. No. 61/138,399, entitled PLAYGROUND EQUIPMENT, which was filed on Dec. 17, 2008; U.S. Provisional Patent Application Ser. No. 61/117,517, entitled PLAYGROUND EQUIPMENT, which was filed on Nov. 24, 2008; and U.S. Provisional Patent Application Ser. No. 61/082,454, entitled PLAYGROUND EQUIPMENT, which was filed on Jul. 21, 2008. Each of these applications is incorporated by reference in its entirety.

BACKGROUND OF THE INVENTION

1. Field of the Invention

The present invention generally relates to playground equipment and other types of play structures for children.

2. Description of Related Art

Conventional playground equipment is often used in a variety of locations and environments such as parks and schools. Children often use playground equipment for various types of fun, games, exercises and other activities.

Playground equipment can also be used at home or in residential settings. Playground equipment that is used at home, which is sometimes referred to as a play structure, may be located in backyards or other suitable locations.

Conventional playground equipment may include swings, slides, bars, ladders, playhouses and climbing walls. Some known playground equipment combines these different elements into a single structure. For example, a single piece of playground equipment may include one or more swings, slides, bars, ladders, playhouses, climbing walls, etc.

Known playground equipment and play structures are difficult to transport and ship because of the large size of the various components. For example, conventional playground equipment and play structures may include support poles that are ten, twelve or fifteen feet in length. In addition, conventional playground equipment and play structures may be packaged within a number of large boxes. These large boxes may be very heavy and awkward to move. In addition, a large amount of unused space may be located within the boxes, which may require a large amount of shipping materials to fill the unused spaced.

Known playground equipment and play structures may also require specialized boxes or containers for shipping, which may undesirably increase shipping and transportation costs. Additionally, these specialized boxes or containers may be quite large or have an odd size and shape, which may also increase shipping and transportation costs. Further, if a consumer purchases the playground equipment or play structures from a retail store, then the large, heavy and/or odd sized packaging and long support poles may make it very difficult or impossible for the consumer to use a conventional automobile to transport the equipment or structures. Instead, the consumer may have to use a truck or a delivery company to deliver the playground equipment or play structure. This may significantly increase costs for the consumer and may discourage the consumer from purchasing the playground equipment or play structures.

BRIEF SUMMARY OF THE INVENTION

A need therefore exists for playground equipment that eliminates or diminishes the disadvantages and problems described above.

One aspect is playground equipment that may include swings, slides, bars, ladders, playhouses, climbing walls and the like. Advantageously, the playground equipment may include any suitable number or combination of swings, slides, bars, ladders, playhouses, climbing walls, etc. The playground equipment may also include only one of these elements, or it may include any combination and number of elements.

Another aspect is playground equipment that may be sized and configured to be used at parks, schools, and the like. The playground equipment may also be sized and configured to be used at homes, residences, etc. Therefore, while the invention may be generally referred to as playground equipment for ease of reference, it will be appreciated that it does not have to be used on playgrounds or in public locations and it could be disposed at various suitable sites, surroundings and environments including at residences and single-family homes. The wording playground equipment is also intended to include play structures, whether for commercial or non-commercial use, and other types of structures for children.

Still another aspect is playground equipment that may include a support structure which is sized and configured to support the playground equipment in a desired configuration and arrangement. The support structure may include one or more elongated support members or poles, and the support members may have a circular, oval, square, rectangular or other cross-sectional configuration. The support members may be disposed in a vertical, horizontal or angled configuration. In addition, one or more of the support members may be connected, such as in an A-frame type arrangement. The support members may be sized and configured to support a portion of the playground equipment, such as swings or slides, above a surface.

Yet another aspect is playground equipment that may include support members which are formed from a number of interconnected sections. For example, instead of having support members that are ten, fifteen or twenty feet in length, or longer, the support members may be constructed from multiple interconnected sections. Significantly, the sections may facilitate manufacturing, shipping, storing and transporting the playground equipment. Additionally, the sections may decrease the size of the packaging and may significantly reduce, if not eliminate, the need for packing material. Further, the smaller size packaging may allow consumers to purchase the playground equipment at a retail store and then more easily transport the playground equipment from the store. In particular, the smaller size packaging may allow a consumer to use a conventional car, pickup truck or sport utility vehicle to transport the playground equipment.

A further aspect is playground equipment that may include a support structure with a plurality of interconnected sections. For instance, a support member may include a first section with a flared or outwardly extending portion that is sized and configured to receive and/or retain a tapered or swaged portion of a second section. The connection of the flared and tapered sections may allow the sections to be connected by a friction or interference fit. In greater detail, the flared portion may extend outwardly about 1 to about 3 degrees and the tapered portion may extend inwardly about 1 to about 3 degrees. Preferably, the flared and tapered portions extend outwardly and inwardly about the same amount, but the flared and tapered portions could extend outwardly and inwardly different amounts. It will be appreciated that the flared and tapered portions could extend outwardly and inwardly any suitable amounts.

A still further aspect is playground equipment that may include a support structure that includes sections connected by swage and flare joints. Advantageously, the swage and flare joints may securely connect the sections. In addition, the swage and flare joints may help align the sections along a desired axis or at a desired angle.

Yet another further aspect is playground equipment that may include interconnected sections that also provide attachment points for components of the playground equipment. For example, two sections of a support member may be connected and that may also provide an attachment point for a component of the playground equipment such as swings, bars, slides, ladders, playhouses, climbing walls and the like.

Another aspect is a support member for playground equipment that may include a first section with a flared end that is connected to a second section with a tapered end. One or more fasteners (such as screws, bolts, rivets and the like) may be used to help align and/or interconnect the first and second sections. For example, the first and second sections may include openings that are sized and configured to be aligned and receive a fastener. In particular, the first section may include an opening that may be aligned with an elongated opening in the second section, and a fastener may be screwed into and/or otherwise inserted through the openings, which may allow the sections to be aligned in a desired arrangement such as along an axis or at an angle. In some embodiments, the fastener may be used to deform at least a portion of the first and/or second sections to help keep the flared and tapered portions connected and/or aligned. The sections may also be connected by other means such as multiple fasteners, adhesives, welding and the like. In addition, other structures may be used to connect and/or align the sections of the support poles such as flanges, protrusions, detents, grooves, channels, etc.

Still another aspect is a support member for playground equipment that may include a plurality of sections and at least one of the sections may include a pilot drill opening which may be sized and configured to be a guide for drilling openings through one or more of the sections. Fasteners may then be inserted through the drilled openings to help secure the sections. For example, a support member may include a first section with a flared portion that is sized and configured to receive and/or retain a tapered or swaged portion of the second section. The flared portion may include at least one pilot drill opening that is sized and configured to be a guide for drilling one or more openings in the flared and/or tapered portions. In particular, the flared portion may include a single pilot drill opening that may be used to drill first and second openings in the tapered portion. The same pilot drill opening may also be used to drill first and second openings in the flared portion. On the other hand, the flared portion may include first and second pilot drill openings and these opening may be used to drill a first and second openings in the flared portion. These first and second pilot drill openings may also be used to drill first and second openings in the tapered portion. One or more fasteners may be inserted through the openings to help secure the first and second sections together. For instance, a single fastener may be inserted through the first and second drilled openings in the flared and tapered portions. Alternatively, a first fastener could be inserted through the first drilled opening in the flared and tapered portions, and a second fastener could be inserted through the second drilled opening in the flared and tapered portions. While the first and second pilot drill openings are preferably disposed in generally opposing locations of the flared portion, it will be appreciated that the pilot drill openings and the drilled openings may be located in various suitable locations of the support member.

Yet another aspect is a support member for playground equipment that may include a fastener inserted through an opening in a flared portion of a first section and an elongated opening or slot in a tapered portion of a second section. After the fastener is inserted, the first and second sections may be pressed or forced together to interconnect the flared and tapered portions, and the fastener may help prevent unintended rotational movement of the sections and may help maintain the sections in the desired alignment. The fastener may then be removed and a pilot drill opening may be used as a guide for drilling additional openings through the sections of the support member. One or more fasteners may be inserted into these openings to help secure the sections together.

A further aspect is a support member for playground equipment that may include a first and second sections connected by a clamp. For example, at least a portion of the second section may be nested within the first section and the clamp may be used to clamp a portion of the first and second sections together. If desired, one or more fasteners may be used to interconnect the nested portions of the first and second sections. In addition, a bolt circle may be used to interconnect the sections, if desired. A connector, which may contain one or more male and/or female portions, may also be used to interconnect the sections. The sections may further be connected by one or more weldments and the like.

A still further aspect is a support member for playground equipment that may be connected and/or aligned using one or more brackets. For example, a first bracket may be connected to a first section and a second bracket may be connected to a second section of the support member. A fastener may be used to connect the brackets, which may also help connect the sections of the support member. Significantly, the brackets and/or the fastener may provide attachment points for various components of the playground equipment. For example, if the sections of the support member are connected by a swage and flare joint, then the brackets may help connect the sections. The brackets and fasteners may also allow other components to be connected to the support member.

Yet another further aspect is support member for playground equipment that may include first and second brackets. A third bracket may be connected to an adjacent support member and a fastener may be used to connect the brackets and the support members. The fastener and/or the brackets may provide an attachment point for other components of the playground equipment. Thus, for example, the same fastener may facilitate connection of the support members and provide an attachment point for a component, such as a swing or bars, to the support member.

Another aspect is playground equipment that may include multiple interconnected support members. For example, the playground equipment may include a first support member that is disposed in one direction, such as horizontal, and two support members that are disposed in other directions, such as generally vertical directions. The multiple support members may be used to form an upper corner of the playground equipment.

Still another aspect is playground equipment that may include multiple support members that are connected by one or more brackets or gussets. For example, two support members may be connected by first and second brackets. These support members may be disposed in a generally upright, A-shaped configuration. A third bracket may be connected to a third support member and the third bracket may be connected to the first and/or second support members. The third bracket may also be connected to the first and/or second brackets. In addition, a fourth bracket may be connected to a third support member. The fourth bracket may be connected to the other brackets and/or support members. The brackets and support members are preferably connected by fasteners. Because the brackets may allow the support members to be easily connected, this may facilitate storing and shipping the support members in an unassembled configuration. Advantageously, this may decrease shipping and transportation costs. In addition, this may allow the playground equipment to be more easily packaged and stored. Further, this may allow the retailer or consumer to easily transport and/or assemble the playground equipment.

Yet another aspect is playground equipment that may include a single fastener that interconnects multiple components. For example, an opening in a first bracket may be aligned with an opening in a second bracket and an opening in a first support member. A single fastener may be used to connect the first bracket, second bracket and first support member. Another opening in the first and second brackets may be aligned with an opening in a second support member. A single fastener may be used to connect the first bracket, second bracket and second support member. Additionally, an opening in the third bracket, an opening in the fourth bracket, and an opening in a third support member may be aligned and a single fastener may connect the third bracket, fourth bracket and third support member. Significantly, because a single fastener may be used to connect one or more brackets and/or support members, this may allow the playground equipment to be more quickly and easily assembled. This may also allow the playground equipment to have fewer components and a less complicated design, which may decrease manufacturing, shipping and storing costs. It will be appreciated that the playground equipment may include any suitable number of brackets, fasteners, support members and the like. In addition, it will be appreciated that the various components of the playground equipment may be connected using welds, adhesives and the like.

These and other aspects, features and advantages of the present invention will become more fully apparent from the following brief description of the drawings, the drawings themselves, and the following detailed description.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limits its scope. Additionally, it will be appreciated that while the drawings may illustrate preferred sizes, scales, relationships and configurations of the invention, the drawings are not intended to limit the scope of the claimed invention. The invention will be described and explained with additional specificity and detail through the use of the accompanying drawings in which:

DETAILED DESCRIPTION OF THE PREFERRED EMBODIMENTS

The present invention is generally directed towards playground equipment. The principles of the present invention, however, are not limited to playground equipment of a certain shape, size, configuration or arrangement. It will be understood that, in light of the present disclosure, the playground equipment disclosed herein can have a variety of shapes, sizes, configurations and arrangements.

The playground equipment may also have a variety of different features, aspects and components. For example, the playground equipment may include one or more swings, slides, ladders, playhouses, climbing walls and the like. Further, as indicated above, these features, aspects and components may be arranged into different configurations and arrangements. Additionally, the playground equipment may be shaped and sized to be used in different locations and environments such as parks, schools, residences, single-family homes and the like. The playground equipment, however, does not have to include any particular features, aspects or components.

In addition, to assist in the description of the playground equipment, words such as top, bottom, front, rear, right and left may be used to describe the accompanying figures. It will be appreciated, however, that the playground equipment can be located in a variety of desired positions and the various components may be disposed in other positions, arrangements and configurations. Further, while the accompanying figures may be drawn to scale, the playground equipment may have other shapes, sizes, dimensions, ratios and the like. A detailed description of the playground equipment now follows.

Figure 1:
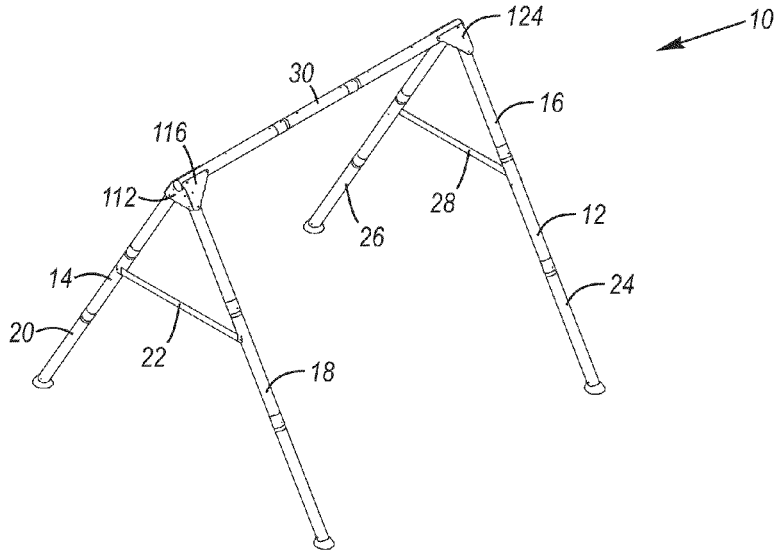
FIG. 1 is a perspective view of exemplary playground equipment, illustrating a support structure for a swing or swing set.
Figure 2:
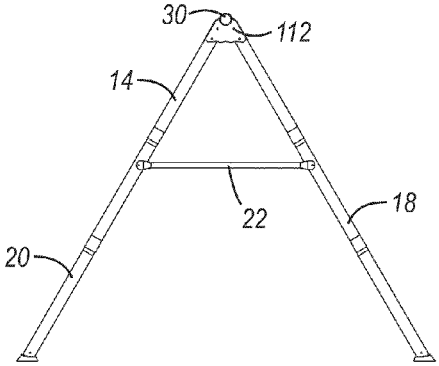
FIG. 2 is a side view of the playground equipment shown in FIG. 1.
Figure 3:
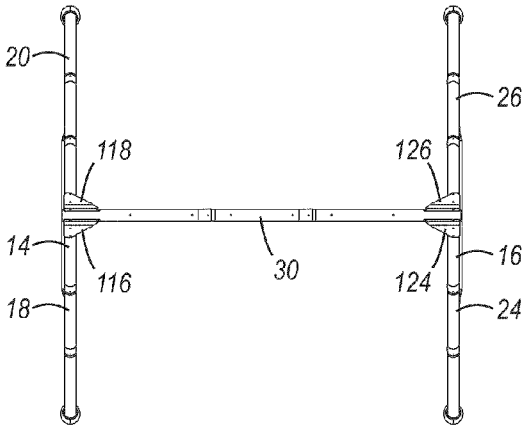
FIG. 3 is a top view of the playground equipment shown in FIG. 1.
Figure 4:
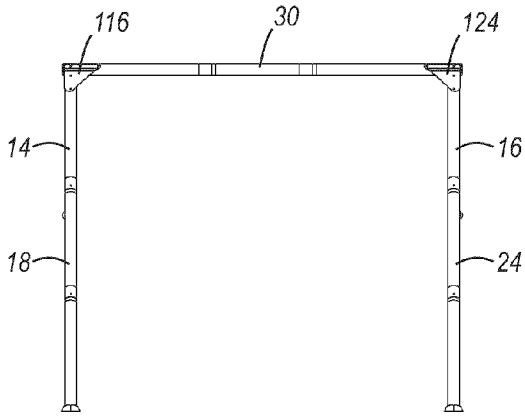
FIG. 4 is a front view of the playground equipment shown in FIG. 1.

As seen in FIG. 1, the playground equipment 10 may include a support structure 12. The support structure 12 may include a first generally vertical support assembly 14 and a second generally vertical support assembly 16. The first generally vertical support assembly 14 may include two support poles or support members 18, 20 that are connected by a connecting member 22. The second generally vertical support assembly 16 may include two support poles or support members 24, 26 that are connected by a connecting member 28. The first and second generally vertical support assemblies 14, 16 preferably have a generally A-shaped configuration but the support assemblies may have other shapes, sizes, configurations and arrangements depending, for example, upon the intended use of the playground equipment 10.

As seen in FIGS. 1-4, the first and second support assemblies 14, 16 may be sized and configured to support a support bar or support member 30. The support member 30 is preferably generally horizontally disposed and is supported above a surface by the first and second support assemblies 14, 16. It will be appreciated that the support structure 12 and the playground equipment 10 may have a variety of different shapes, sizes, configurations and arrangements depending, for example, upon the particular features, aspects and components of the playground equipment.

As shown in the accompany drawings, the support structure 12 may be constructed from various components or sections that are interconnected. For example, the support members 18, 20, 24, 26, 30 may each be formed from two or more interconnected sections. Therefore, instead of having support poles that are ten, fifteen or twenty feet in length, or longer, the support structure 12 may include support members that are divided into multiple sections and interconnected. Significantly, forming the support members 18, 20, 24, 26, 30 by connecting multiple sections together may facilitate shipping, storing and transporting the playground equipment 10. This may also decrease the size of the packaging and may eliminate the need for much, if not all, of the packing material required to ship the playground equipment 10. Further, the smaller size packaging may allow consumers to purchase the playground equipment 10 at a retail store and then more easily transport the playground equipment from the store to their home or other desired location.

In greater detail, as shown in FIGS. 1-4, the support members 18, 20, 24, 26 and 30 may consist of three interconnected sections. It will be appreciated that the support members 18, 20, 24, 26 and 30 may be constructed from any suitable number of sections depending, for example, upon the shape, size, configuration and/or arrangement of the playground equipment 10.

Figure 5:
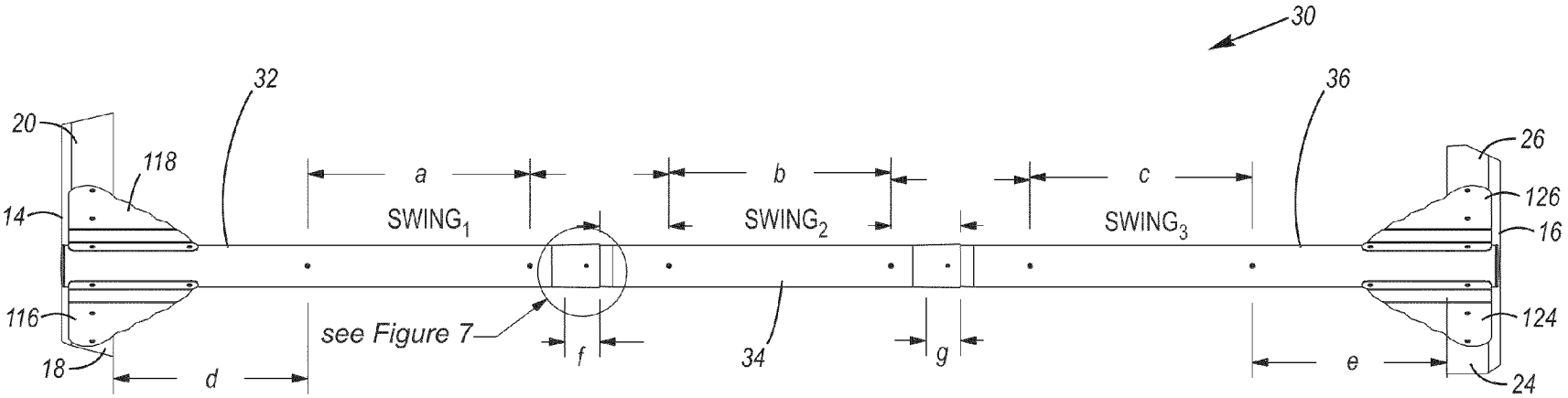
FIG. 5 is an enlarged top view of a portion of the playground equipment shown in FIG. 1.
Figure 6:
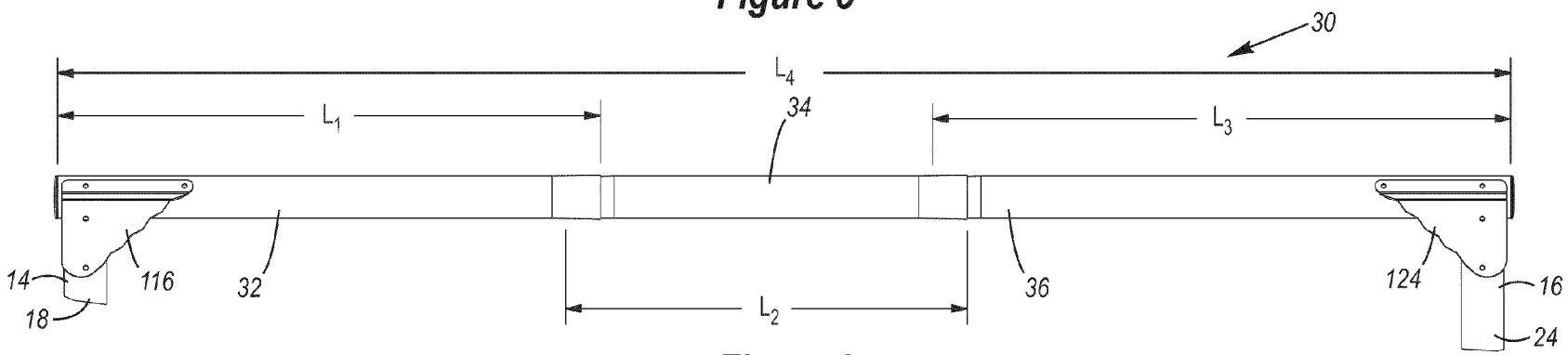
FIG. 6 is an enlarged front view of a portion of the playground equipment shown in FIG. 1.

As shown in FIGS. 5 and 6, the support member 30 may be constructed from a first section 32, a second section 34 and a third section 36. The first section 32 may be supported by the first support assembly 14 and the third section 36 may be supported by the second support assembly 16. The first section 32 may have a length L1 and the third section 36 may have a length L3. If desired, the first section 32 and the third section 36 may have approximately the same length. The second section 34 may be disposed between the first and third sections 32, 36 and the second section may have a length L2, which may be shorter than the length L1 of the first section 32 and/or the length L3 of the third section 36. The overall length L4 of the support member 30 may be less than the combined length of the lengths L1, L2 and L3 because a portion of the sections 32, 34, 36 may overlap.

As shown in FIG. 5, one or more components may be attached to the support member 30. For example, three swings may be attached to the support member 30 and the first swing may have a width a, a second swing may have a width b, and the third swing may have a width c. In this exemplary embodiment, the width of the three swings may be generally equal, but the width of the swings may vary and the width may also vary according to the type of component attached to the support member 30 such as bars, slides, ladders, playhouses, climbing walls, etc.

As shown in FIG. 5, if the support member 30 supports three components, then these components may be spaced apart by a generally consistent distance. In greater detail, the first swing may be spaced apart from the first support assembly 14 by a distance d and the third swing may be spaced apart from the second support assembly 16 by a distance e. The first and second swings may be spaced apart by a distance f, and the second and third swings may be spaced apart by a distance g. The distances f and g between the swings may be generally equal, and the distances d and e between the swings and the supports assemblies 14, 16 may be generally equal. It will be understood that the playground equipment 10 may include any desired number of swings and other components, and these various components may be separated by different distances depending, for example, upon the intended use of the playground equipment. Further, it will be understood that the support member 30 may include any number of sections depending, for example, upon the desired length of the support member. Advantageously, because the support member 30 may be constructed from one or more sections, the length of the support member may be easily changed. For example, if additional components are desired to be attached to the support member 30, then additional sections may be added. On the other hand, if fewer components are desired to be attached to the support member 30, then the support member may be constructed from fewer sections.

Figure 10:
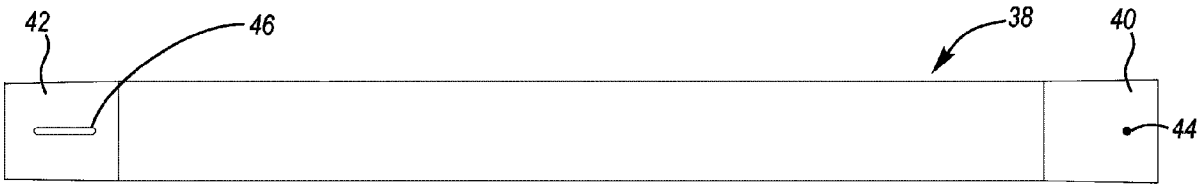
FIG. 10 is a rear view of the support member shown in FIG. 8.
Figure 11:
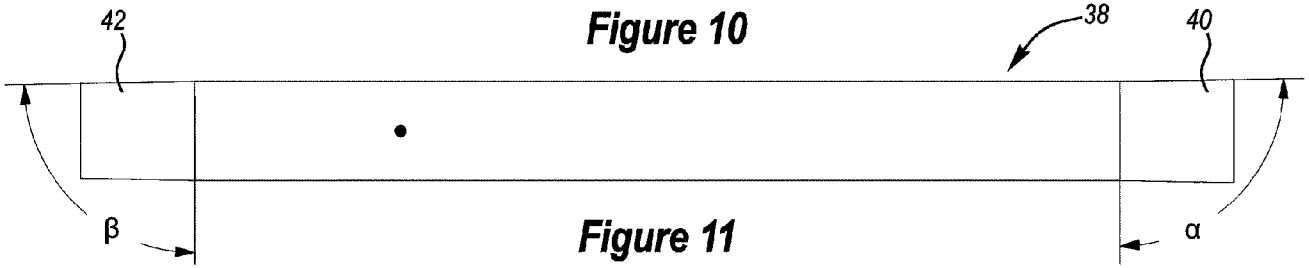
FIG. 11 is a bottom view of the support member shown in FIG. 8.

As shown in FIGS. 8-11, an exemplary section 38 of the support structure 12, which may form a section of the support member 18, 20, 24, 26 or 30, may have a flared or outwardly extending end 40 and a tapered or swaged end 42. For example, as shown in FIG. 11, the flared end 40 may extend outwardly at an angle $\alpha$ of approximately 1° and the tapered end 42 may extend inwardly at an angle $\beta$ of approximately 1°. It will be appreciated that the flared end 40 and the tapered end 42 may also extend outwardly and inwardly a greater amount, such as an angle $\alpha$ or $\beta$ of about 2°, about 3°, about 4° or about 5°, or lesser amount, such as an angle $\alpha$ or $\beta$ of about ½° or about ¼°, depending, for example, upon the intended use of the playground equipment 10. The flared and swaged ends 40, 42 are preferably sized and configured to allow the sections 38 to be quickly and easily connected. For example, two sections 38 may be aligned and the tapered end 42 may be inserted into the flared end 40, which may allow the sections to be connected by a friction or interference fit.

Figure 7:
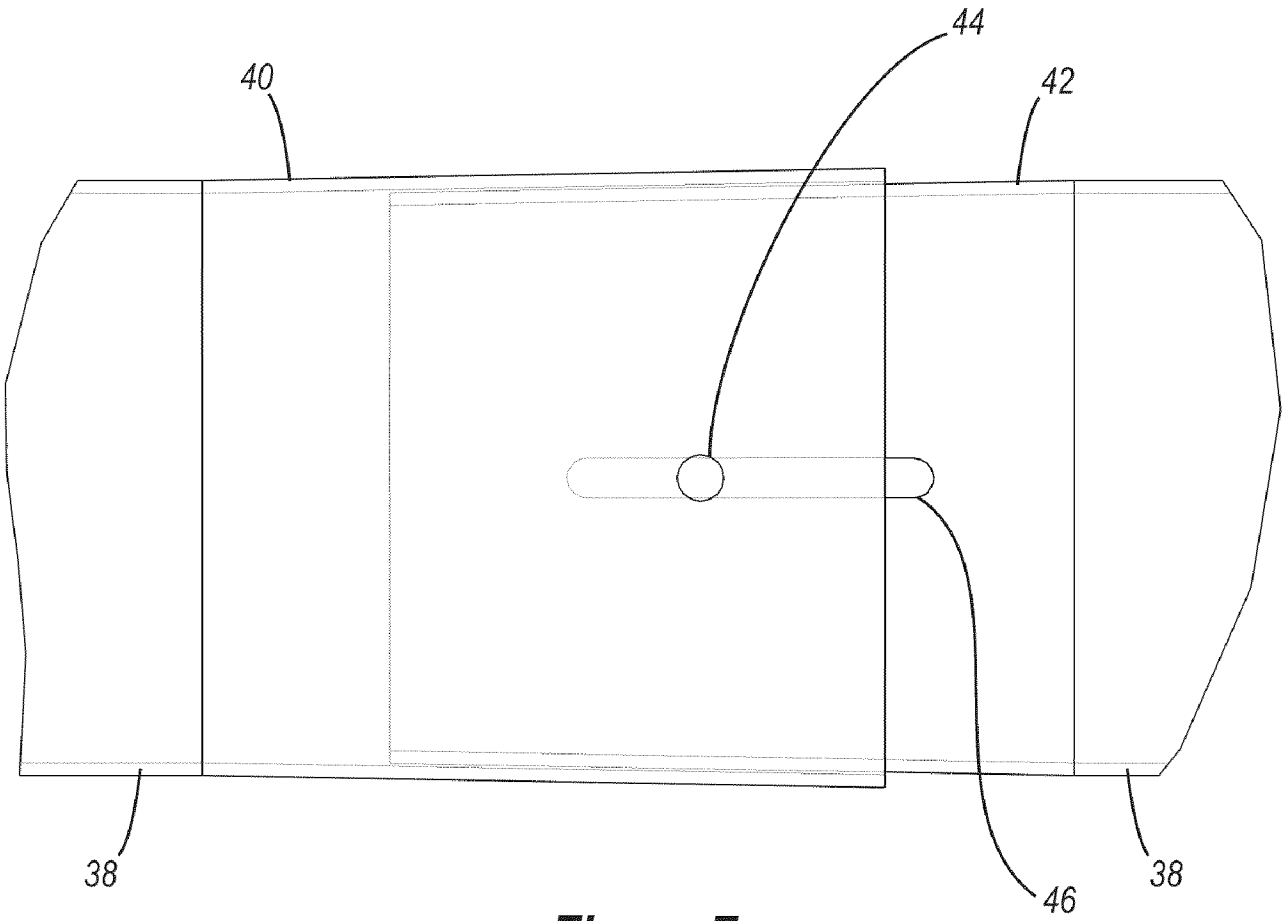
FIG. 7 is an enlarged top view of a portion of the playground equipment shown in FIG. 5.

As shown in FIG. 10, the flared end 40 of the exemplary section 38 may include an opening 44, which may have a generally circular cross-sectional configuration, and the tapered section 42 may include an opening 46, which may be a slot. As shown in FIG. 7, when the flared end 40 and the tapered end 42 of the exemplary sections 38 are connected, the opening 44 may be aligned with the slot 46. When the opening 44 is aligned with the slot 46, a fastener 48 or other type of alignment member may be disposed in the opening and slot. Advantageously, when the flared end 40 and the tapered end 42 of the sections 38 are joined together, the fastener 48 may help maintain the desired alignment between the sections. The fastener may also facilitate joining the flared and tapered ends 40, 42 without undesired twisting or rotational movement of the sections 38.

In greater detail, in order to connect two sections, the tapered end 42 of a first exemplary section 38 may be inserted into the flared end 40 of a second exemplary section, and the fastener 48 may be inserted into the aligned openings 44, 46. The first and second sections 38 may be positioned vertically above a surface, which may be a relatively strong and resilient material such as wood or plastic, and the sections may then strike the surface from a distance of about twenty to twenty-five inches. This step may be repeated until the flared and tapered ends 40, 42 are securely connected. It will be appreciated that the sections 38 may be joined or connected in any suitable manner or using other appropriate methods.

Figure 8:
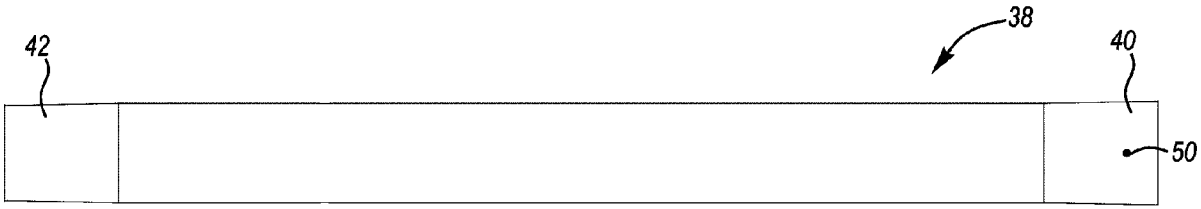
FIG. 8 is a front view of a portion of the playground equipment shown in FIG. 1, illustrating a section of a support member or support pole.
Figure 9:
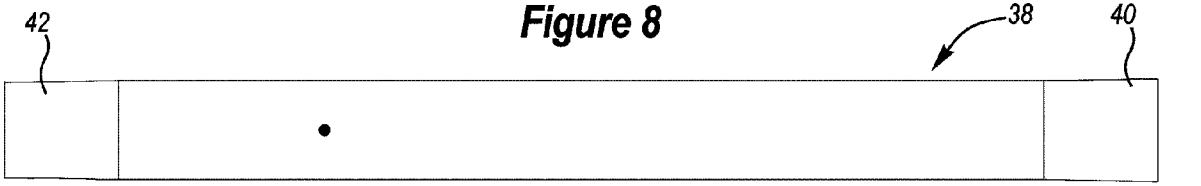
FIG. 9 is a top view of the support member shown in FIG. 8.

If desired, the fastener 48 may then be removed and the opening 44 in the flared end 40 may be used as a guide to drill a larger opening in the flared end. The opening 44 may also be used as a guide to drill a larger opening in the tapered end 42. This may allow a larger fastener to be used to secure the two sections 38 together. In addition, the larger drilled opening and fastener may help prevent the two sections 38 from sliding relative to each other. As shown in FIG. 8, a second opening 50, or other marking or indicia, may be disposed in or on the tapered end 42. This second opening 50, which may be disposed generally opposite the first opening 44, may be sized and configured to help securely connect the sections 38 together. For example, the second opening 50 may be used as a guide to drill a second opening in the flared end 40 and the tapered end 42 of the sections 38. This may allow a single fastener, such as a bolt, to end through both sides of the flared and tapered ends 40, 42 of the sections 38. On the other hand, a first fastener may be connected to one side of the flared and tapered ends 40, 42 of the sections 38 and a second fastener by may be connected to the other side of the flared and tapered ends of the sections.

Figure 12:
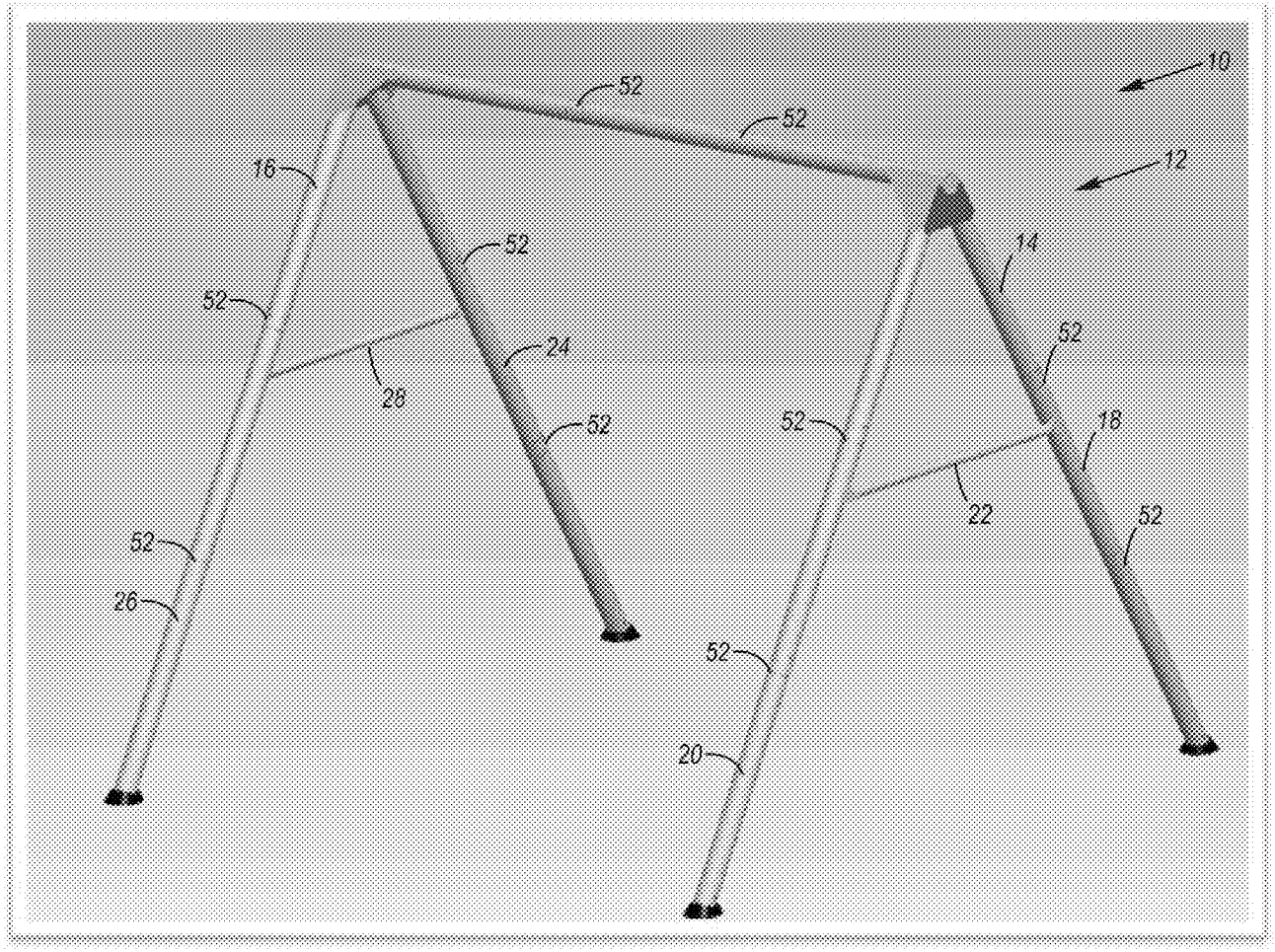
FIG. 12 is a perspective view of the playground equipment shown in FIG. 1.
Figure 13:
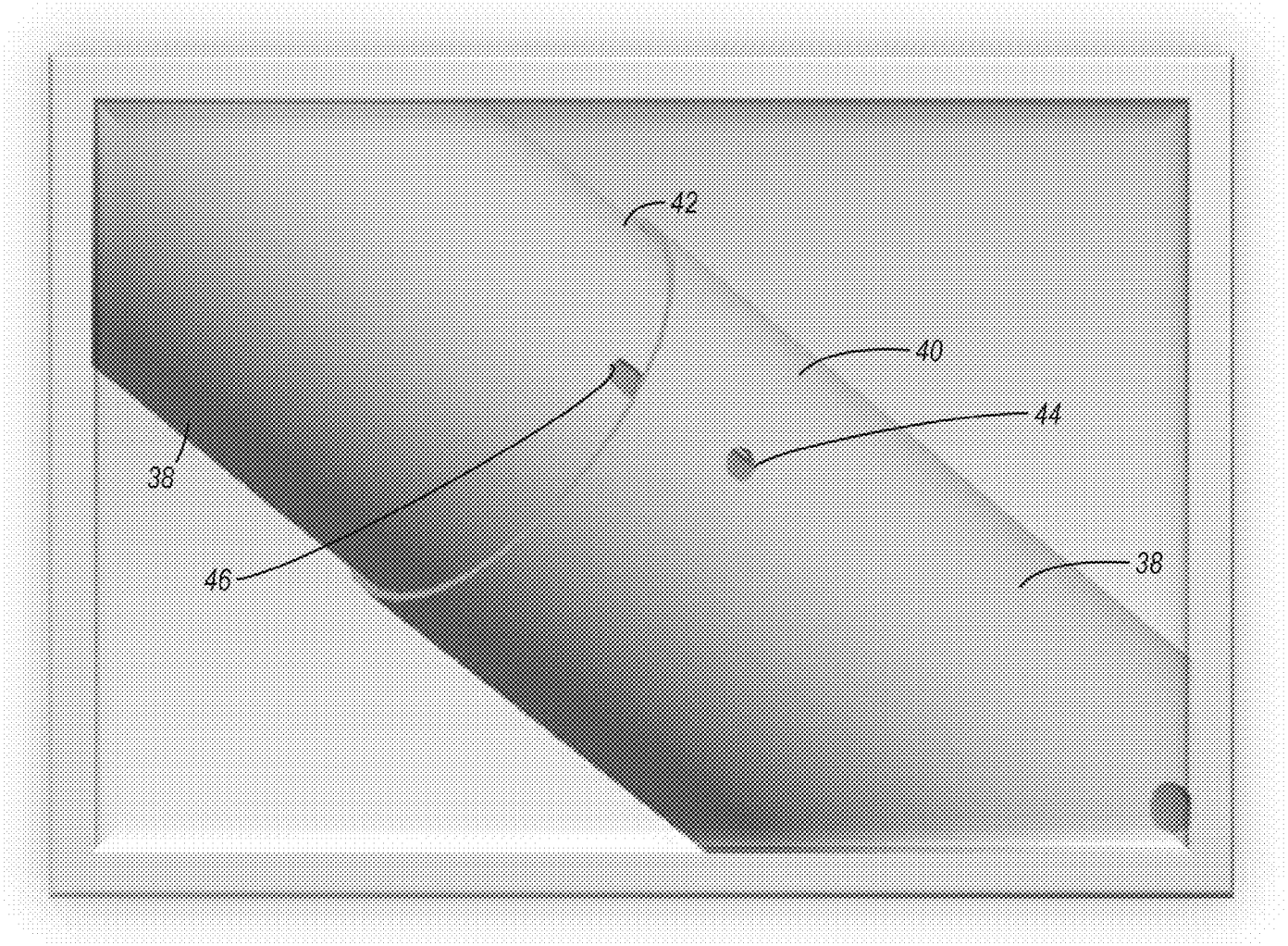
FIG. 13 is an enlarged perspective view of a portion of the playground equipment shown in FIG. 12.

As shown in FIGS. 12 and 13, the support members 18, 20, 24, 26 and 30 may be constructed from a number of sections that are connected at connections 52. For example, each support member 18, 20, 24, 26 and 30 may include three sections that are joined at two connections 52. Advantageously, the same type of connections 52 may be used to connect the various sections, whether the sections are generally vertically disposed, generally horizontally disposed, or disposed at an angle. It will be appreciated that the same type of connections 52 do not have to be used to connect the various sections of the support members 18, 20, 24, 26 and 30.

Figure 14:
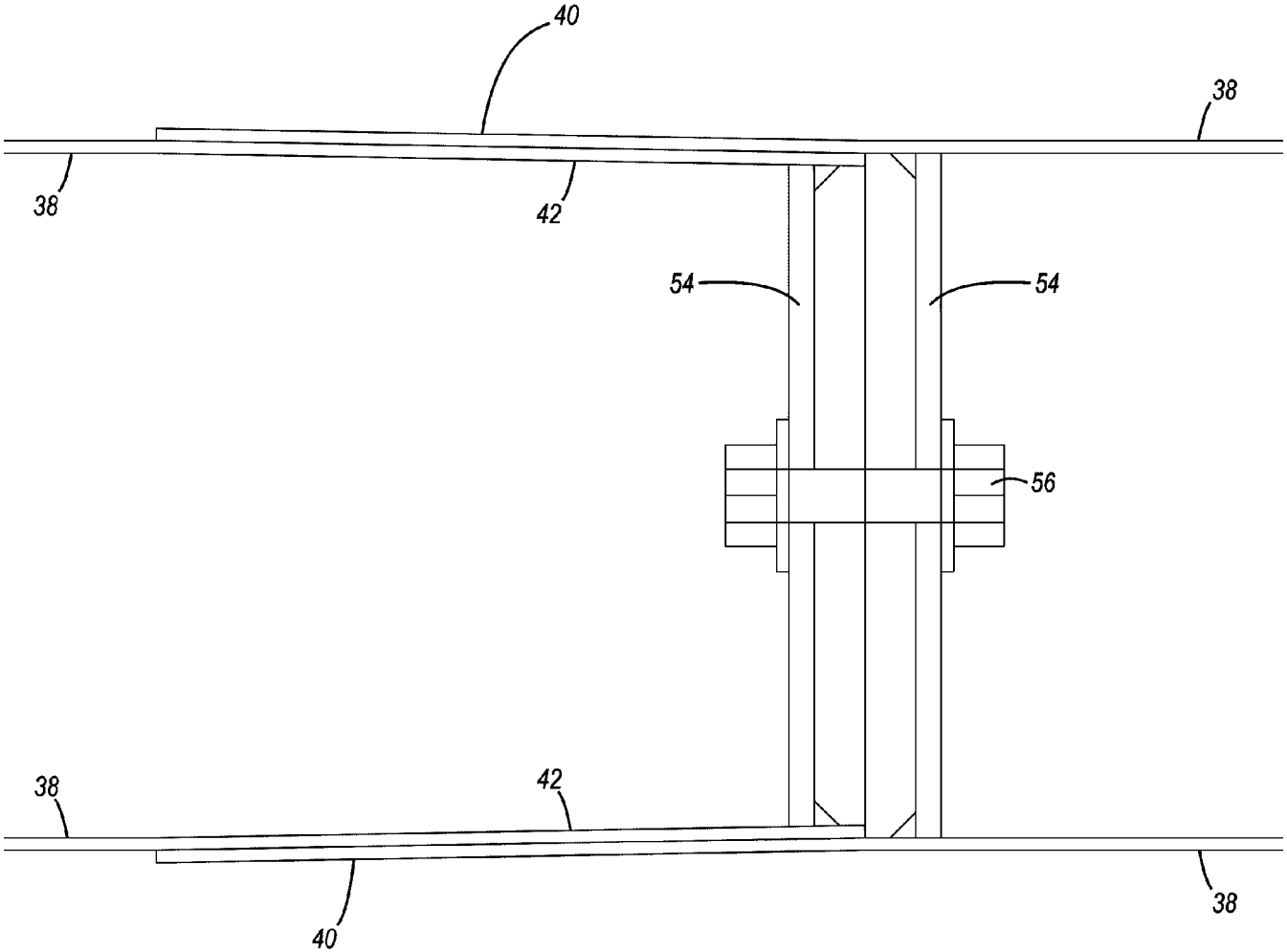
FIG. 14 is a cross-sectional view of an exemplary connection of the playground equipment.

In addition, as shown in FIG. 14, the connections 52 may also be secured by one or more welds or weldment 54. For example, the flared end 40 and tapered end 42 of two exemplary sections 38 may overlap and may be connected by a friction or interference fit. In addition, the exemplary sections 38 may be connected by a fastener 56. Further, first and second weldments 54 may be used to connect the sections 38. It will be appreciated that while the sections 38 may be connected by the flared 40 and tapered ends 40, 42; fasteners 48, 56; and/or the weldments 54, the sections could be connected by other suitable structures or components.

Figure 15:
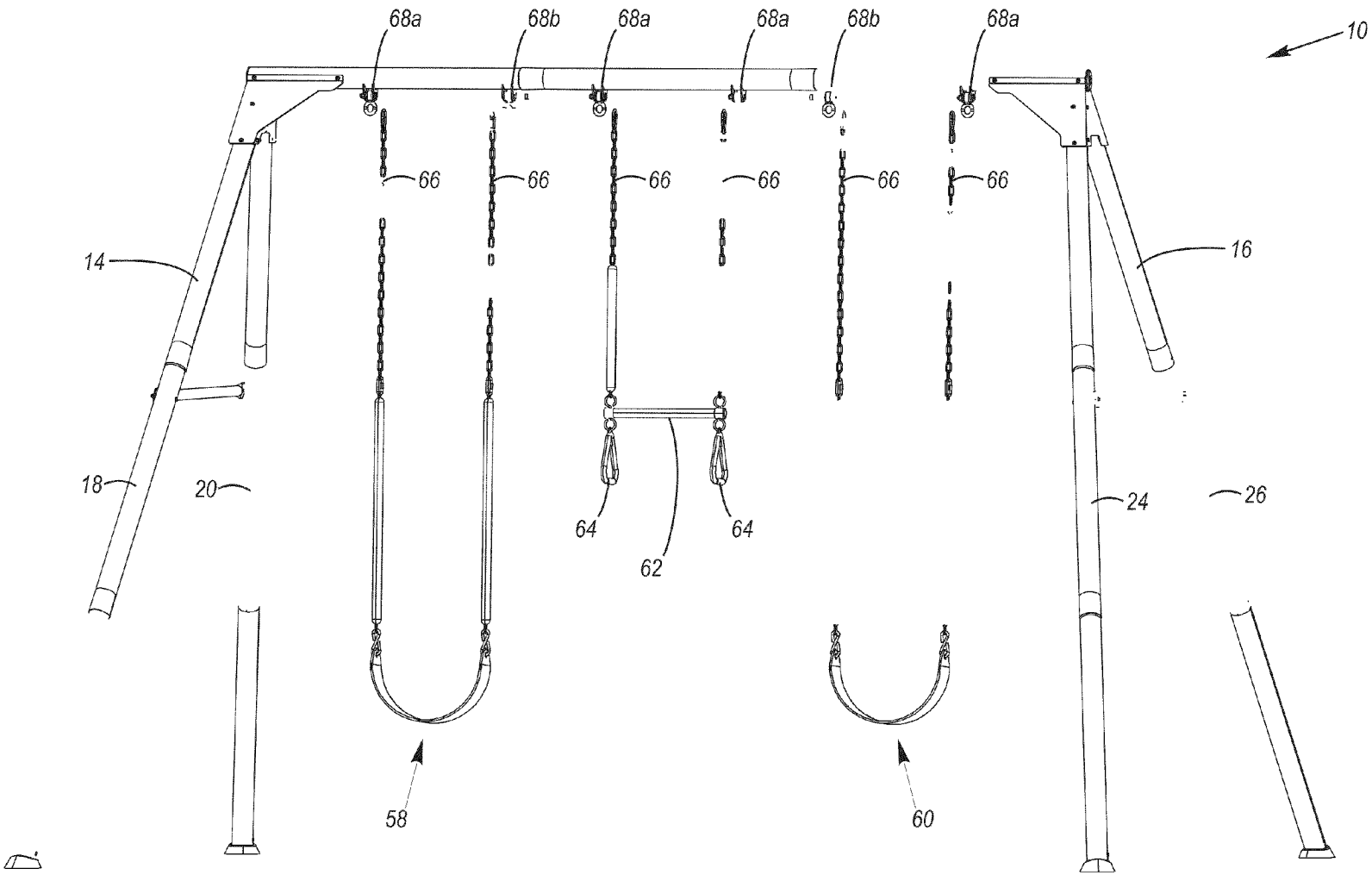
FIG. 15 is a partially exploded perspective view of exemplary playground equipment.

As shown in FIG. 15, an exemplary embodiment of the playground equipment 10 may include components consisting of two swings 58, 60 and a bar 62 with handles 64. The swings 58, 60 and the bar 62 are preferably secured to the support member 30 by tethers 66, such as chains. The tethers 66 are preferably attached to the support member 30 by attachment assemblies 68. The attachment assemblies 68 may be spaced apart by a desired distance and the attachment assemblies may be spaced apart from the first and second support assemblies 14, 16 by a desired distance.

The attachment assemblies 68 may facilitate attachment of the components to the support structure 12. The attachment assemblies 68 may also facilitate connection of the sections of the support structure 12. In addition, the attachment assemblies 68 may have different shapes, sizes, configurations and arrangements depending, for example, upon the intended use, function or purpose of the attachment assembly. For example, a one type of attachment assembly 68 may provide an attachment point for a component to be attached to the support structure 12 of the playground equipment 10. Another type of attachment assembly 68 may be used to provide an attachment point for a component to be attached to the support structure 12 of the playground equipment 10 and to help connect sections of the support structure.

Figure 16:
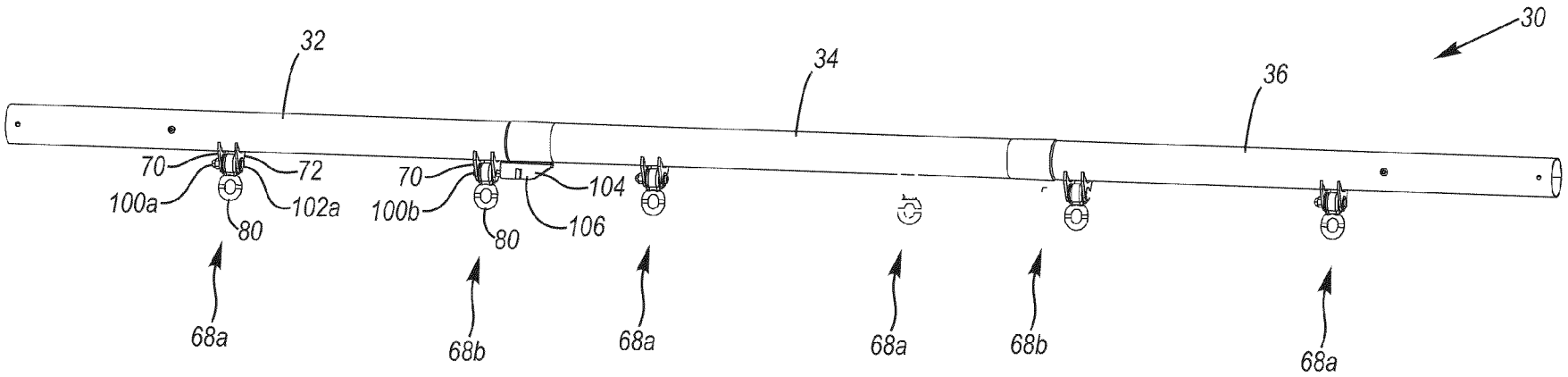
FIG. 16 is an enlarged perspective view of a portion of the playground equipment shown in FIG. 15.
Figure 17:
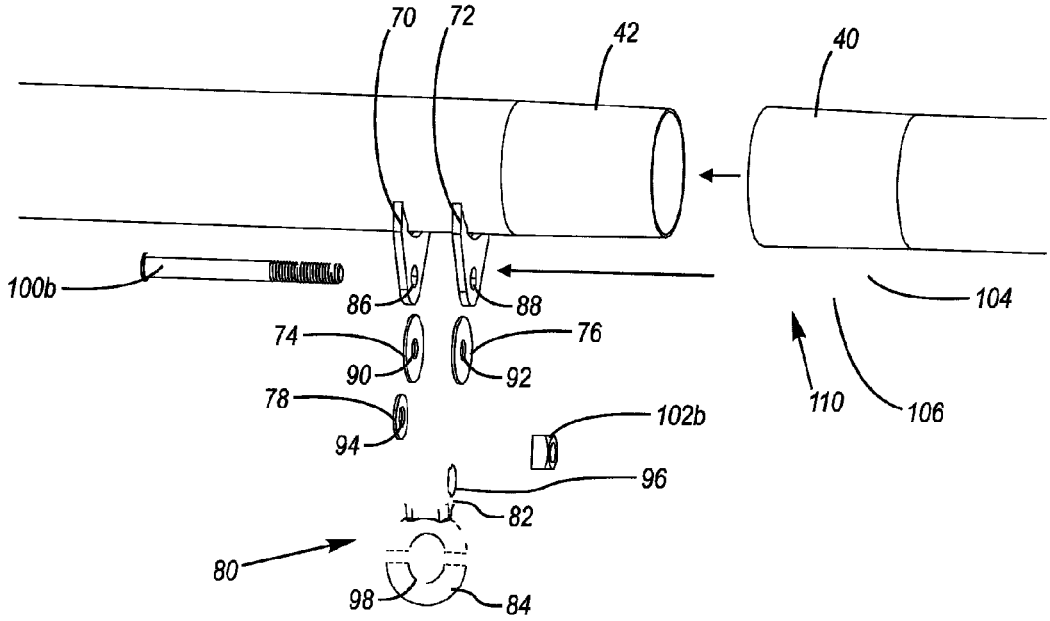
FIG. 17 is an enlarged, partially exploded view of a portion of the playground equipment shown in FIG. 15, illustrating a connection in an unassembled configuration.
Figure 18:
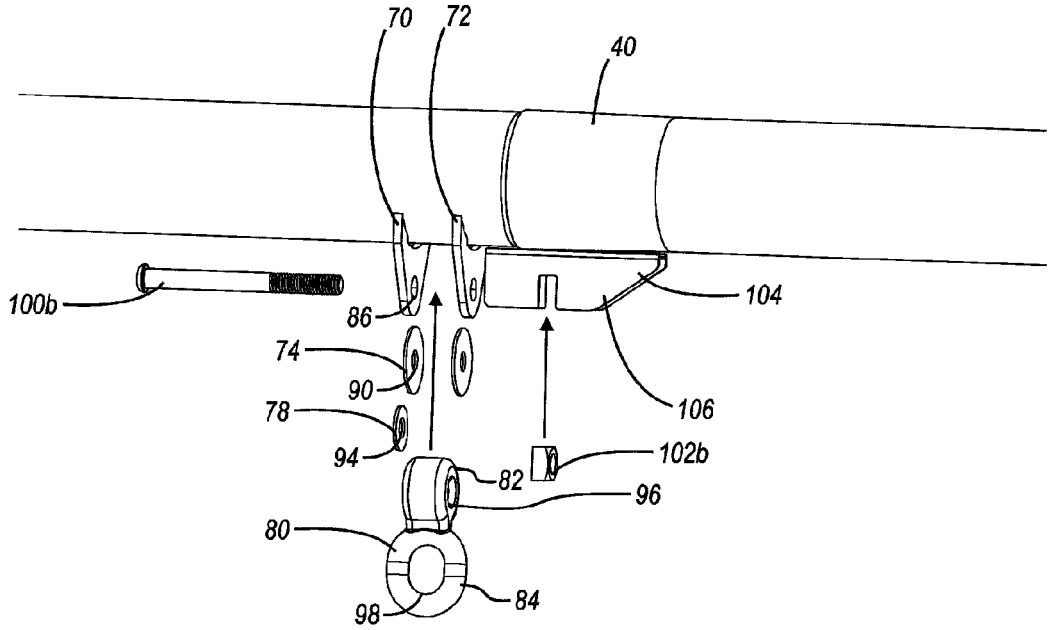
FIG. 18 is an enlarged, partially exploded view of a portion of the playground equipment shown in FIG. 15, illustrating a connection in a partially unassembled configuration.
Figure 19:
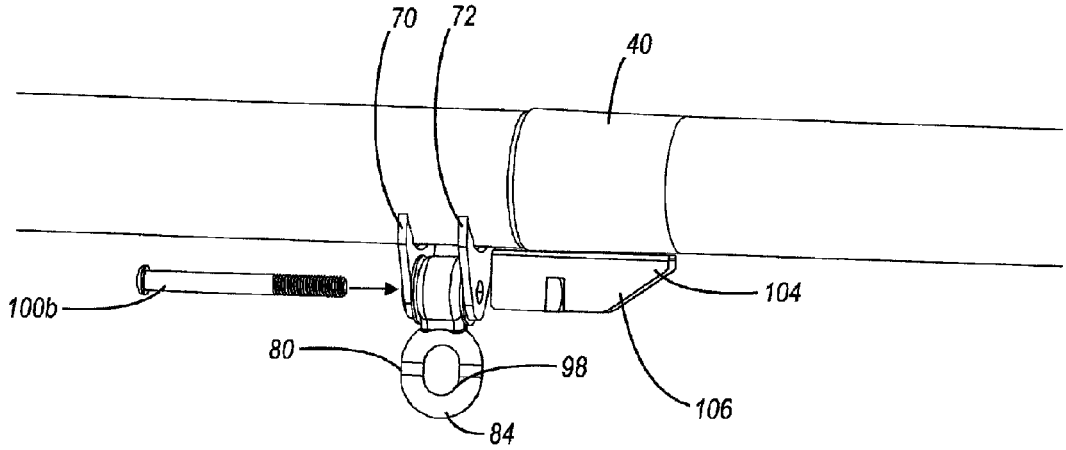
FIG. 19 is an enlarged, partially exploded view of a portion of the playground equipment shown in FIG. 15, illustrating a connection in a partially assembled configuration.
Figure 20:
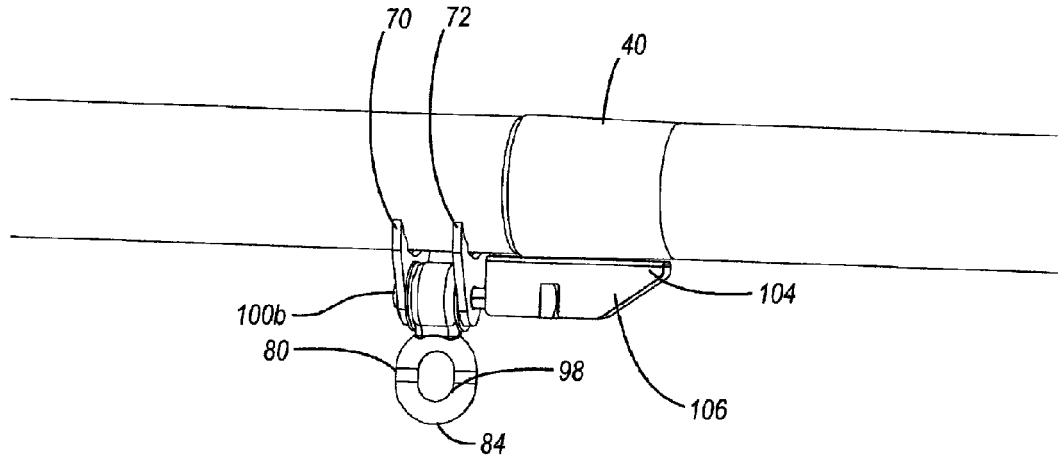
FIG. 20 is an enlarged perspective view of a portion of the playground equipment shown in FIG. 15, illustrating a connection in an assembled configuration.
Figure 22:
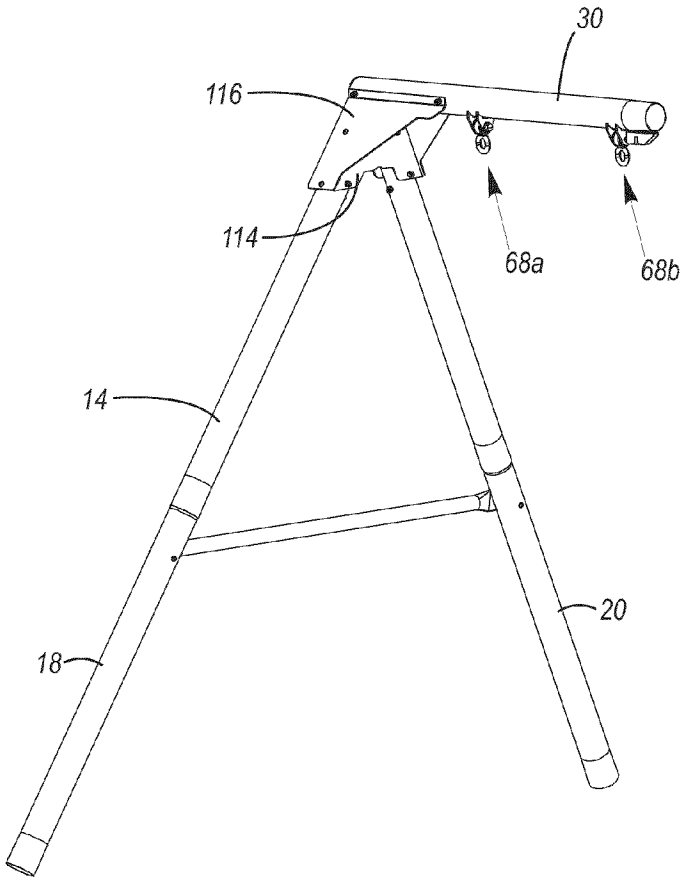
FIG. 22 is another enlarged perspective view of the portion of the playground equipment shown in FIG. 1, illustrating brackets that may be used to interconnect a plurality of support members.
Figure 21:
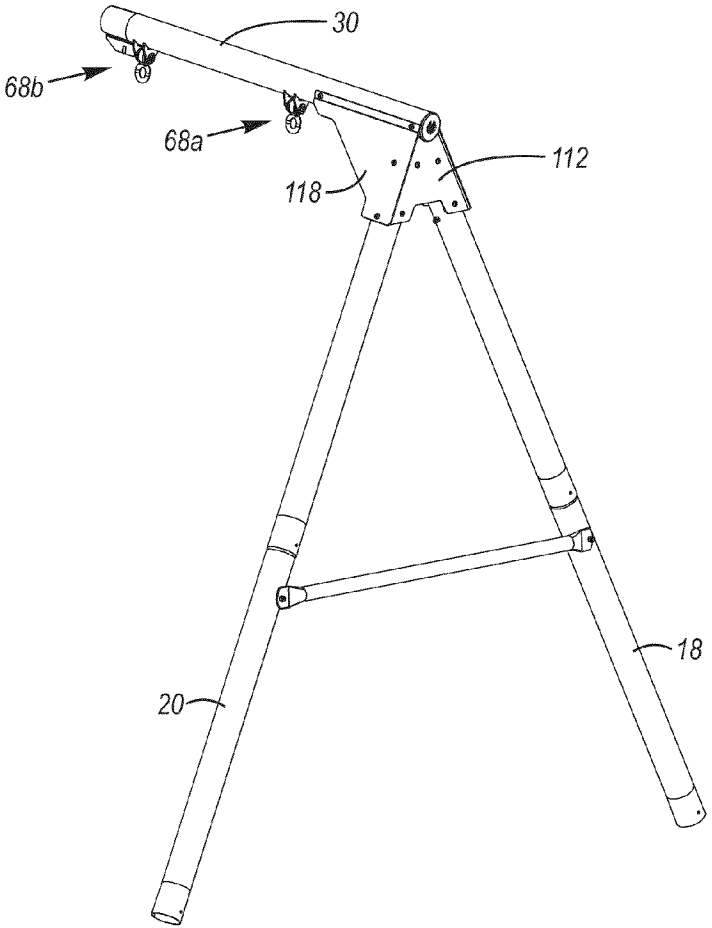
FIG. 21 is an enlarged perspective view of a portion of the playground equipment shown in FIG. 1, illustrating brackets that may be used to interconnect a plurality of support members.
Figure 24:
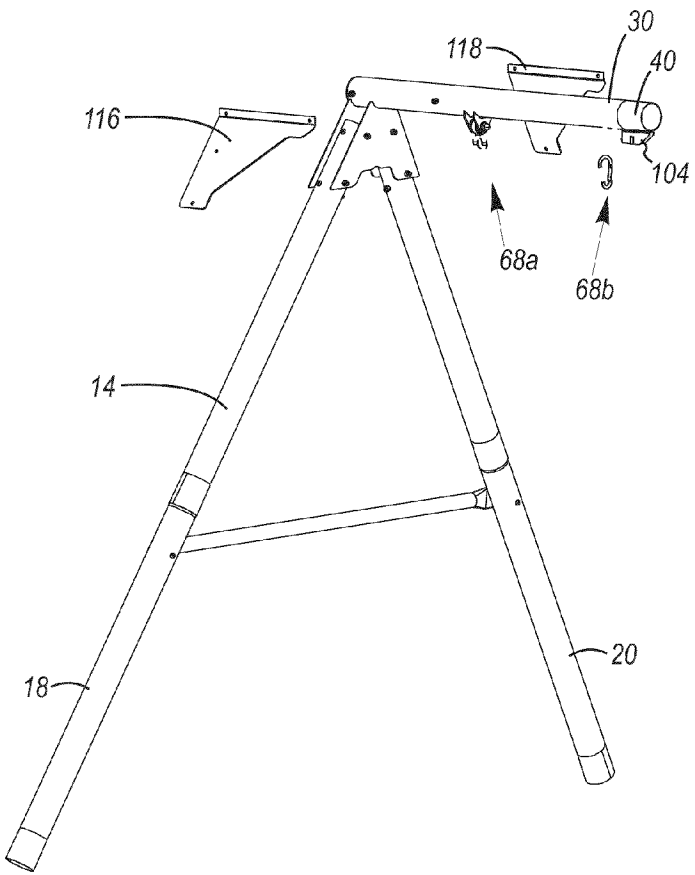
FIG. 24 is still another enlarged, partially exploded, perspective view of the portion of the playground equipment shown in FIG. 1.
Figure 23:
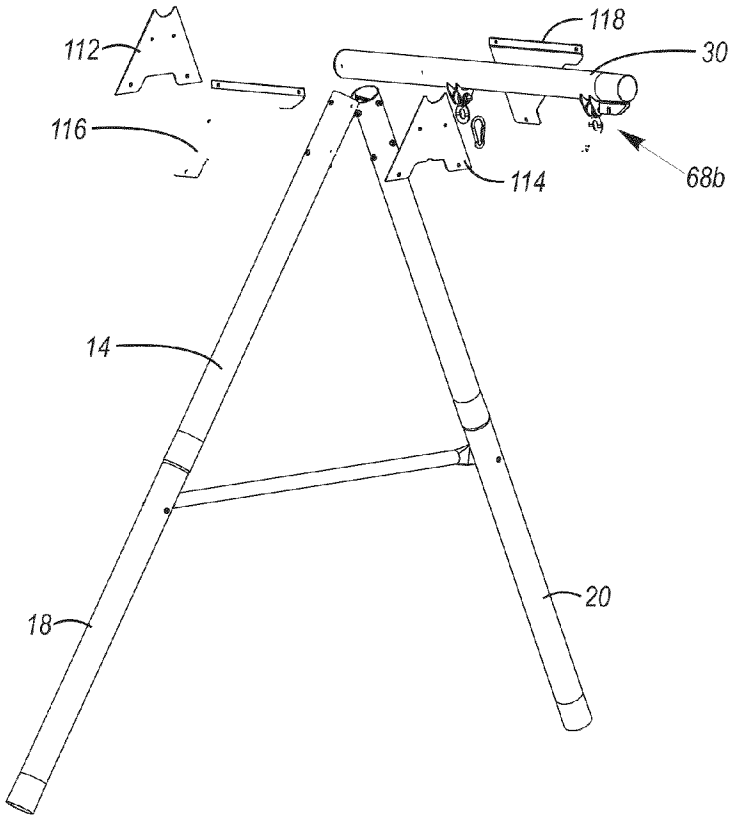
FIG. 23 is an enlarged, partially exploded, perspective view of the portion of the playground equipment shown in FIG. 1.

For instance, as shown in FIGS. 15 and 16, an attachment assembly 68*a* may be disposed away from the ends of the sections 32, 34 and 36 of the support member 30. An attachment assembly 68*b* may be disposed proximate the ends of one or more of the sections 32, 34 and 36 of the support member 30. In particular, a first attachment assembly 68*a* may be disposed away from the ends of the section 32 and a second attachment assembly 68*b* may be disposed proximate an end of the section 32. Similarly, the third section 36 may include an attachment assembly 68*a* disposed away from the ends of the section and a second attachment assembly 68*b* disposed proximate an end of the section. The second section 34 may include two attachment assemblies 68*a* disposed away from the ends of the sections. It will be appreciated that the attachment assemblies 68*a*, 68*b* may be disposed in other locations and attached to other portions of the playground equipment 10 depending, for example, upon the type of components to be attached to the support structure 12 and/or the intended use of the playground equipment 10.

In greater detail, the attachment assemblies 68*a* may provide attachment points for components such as the swings 58, 60 and the bars 62. The attachment assemblies 68*b* may provide both attachment points for the swings 58, 60 and the bars 62, and facilitate connection of the sections 32, 34, 36. Advantageously, the attachment assemblies 68*a* and 68*b* may have a similar shape, size, configuration and arrangement. In addition, the attachment assemblies 68*a* and 68*b* may use many of the same parts and pieces. It will be appreciated that the attachment assemblies 68*a*, 68*b* may have other suitable shapes, sizes, configurations and arrangements depending, for example, upon the intended use of the playground equipment 10.

As best seen in FIGS. 15-20, the attachment assemblies 68*a*, 68*b* may include two flanges or brackets 70, 72 connected to the support member 30. The flanges 70, 72 may be connected to the support member 30 by welding or by other suitable means. The attachment assemblies 68*a*, 68*b* may also include two washers 74, 76, which may be disposed between the flanges 70, 72, and another washer 78, which may be disposed outside the flanges. The attachment assemblies 68*a*, 68*b* may further include a connecter 80 including a first end 82 that is sized and configured to be disposed between the flanges 70, 72 and a second end 84 that is sized and configured to be disposed outside of the flanges. The flanges 70, 72 preferably include openings 86, 88 that may be aligned with openings 90, 92, 94 in the washers 74, 76, 78, respectively, and an opening 96 in the first portion 82 of the connector 80. These parts of the attachment assemblies 68*a*, 68*b* are preferably the same. Advantageously, these similar parts may simplify the manufacturing process and may make the playground equipment 10 easier to assemble.

The attachment assembly 68*a* may include a fastener 100*a* that may be inserted through the openings 86, 88, 90, 92, 94 and 96 to connect the connector 80 to the support member 30. If the fastener 100*a* is a bolt, then a nut 102*a* may be secured to the bolt to securely connect the connector 80 to the support member 30. The connector 80 is preferably pivotally connected to the support member 30 by the attachment assembly 68*a*. The second portion 84 of the connector 80 may include an opening 98 that is sized and configured to be connected to a component of the playground equipment 10 such as the swings 58, 60; or the bar 62. Specifically, the connector 80 may be connected to the tether 66 of the swings 58, 60 or the bar 62.

The attachment assembly 68*b*, as shown in FIGS. 17-20, may have a similar structure and components as the attachment assembly 68*a*, but it may include a fastener 100*b* that is inserted through the openings 86, 88, 90, 92, 94 and 96 to connect the connector 80 to the support member 30. The attachment assembly 68*b* may also include a bracket 104 that is attached to another section of the support member 30. The bracket 104 may include a flange 106 with a first opening 108 that is sized and configured to receive the end of the fastener 100*b* and a second opening 110 that is sized and configured to receive a nut 102*b*. The end of the fastener 100*b* may be inserted through the first opening 108 and connected to the nut 102*b* disposed within the opening 110. Advantageously, the fastener 100*b* may both connect the connector 80 to the support member 30 and it may also help connect two adjacent sections of the support member. Significantly, as the fastener 100*b* is tightened, it may force the ends of the sections together. The fastener 100*b* may also help prevent the sections from unintentionally detaching. Therefore, the fastener 100*b* may both provide an attachment point and help lock the sections together.

The support structure 12 may also include one or more support members that are connected at an angle. These support members are preferably connected by gussets and fasteners, which may facilitate assembly of the support structure 12. In particular, because the support members may be connected by retailers and consumers, this may also facilitate manufacturing because the support structure 12 may be manufactured in multiple different pieces and then the retailer or consumer may easily assemble the pieces into the desired structure. In addition, this may facilitate shipping and storage because the smaller components may be disposed in smaller packaging, which may be easier to ship and store.

For example, as shown in FIGS. 21-24, the first and second support members 24, 26 of the first support assembly 14 may be connected to the support member 30 by one or more gussets. In particular, a first gusset 112 may be attached to the first support member 18 and the second support member 20 of the first support assembly 14. If desired, a second gusset 114 may be attached to the first support member 18 and the second support member 20. The gussets 112, 114 may be securely connected to the support members 18, 20 by fasteners, which may eliminate the need for welding the support members together. In addition, a single fastener may connect the gussets 112, 114 to the first support member 18 and a single fastener may connect the gussets to the second support member.

A third gusset 116 may be attached to the first support member 18 and the support member 30, and a fourth gusset 118 may be attached to the second support member 20 and the support member 30. The gussets 116, 118 may be securely connected to the support members 18, 20, 30, respectively, by fasteners and that may eliminate the need for welding the support members together. If desired, a single fastener may connect the gussets 116, 118 and the support member 30. Thus, the gussets 112, 114, 116, 118 may allow the support members 18, 20, 30 to be securely connected together, which may allow a strong and sturdy support structure 12 to be created. In addition, the gussets 112, 114, 116, 118 may allow the support members 18, 20, 30 to be connected with relatively few fasteners.

The gussets 112, 114, 116, 118 may allow the first support member 18 and the second support member 20 to be disposed in a generally upwardly extending configuration, while the support member 30 may be disposed in a generally horizontal configuration. In greater detail, the first and second gussets 112, 114 may allow the first and second support member 18, 20 to be disposed in a generally upright, A-shaped configuration. The third and fourth gussets 116, 118 may allow the support member 30 to be disposed in the generally horizontal direction. Because the gussets 112, 114, 116, 118 may allow the support members 18, 20, 30 to be easily connected, this may facilitate storing and shipping the support members in an unassembled configuration, which may decrease shipping and transportation costs. It will be appreciated that the support members 24, 26 of the second support assembly 16 may similarly be connected by gussets 120, 122, 124 and 126.

As indicated above, a single fastener may connect one or more of the gussets and support members. For example, a single fastener may connect the gussets 112, 114 to the support member 18 and a single fastener may connect the gussets 112, 114 to the support member 20. In addition, a single fastener may connect the gussets 116, 118 to the to the support members 18, 20. Further, a single fastener may connect the gussets 116, 118 to the support member 30. Significantly, because each fastener may be used to connect one or more gussets and/or support members, this may allow the playground equipment 10 to be quickly and easily assembled. This may also allow the playground equipment 10 to have few components and an uncomplicated design, which may decrease manufacturing, shipping and storing costs. It will be appreciated that the playground equipment 10, however, may include any suitable number of gussets, fasteners and the like. It will also be appreciated that the various components of the playground equipment may be connected using other suitable structures and means such as welds, adhesives and the like.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A support member for playground equipment, the support member comprising:

a first section including a flared end;

an opening in the flared end of the first section;

a second section including a tapered end, the tapered end being sized and configured to be inserted into the flared end of the first section;

an elongated slot in the tapered end of the second section;

a first fastener configured to be disposed in the opening in the flared end of the first section and disposed towards a first end of the slot in the tapered end of the second section when the flared end and the tapered end overlap a first amount, the first fastener being configured to be disposed towards a second end of the slot when the flared end and the tapered end overlap a second amount, the first fastener being sized and configured to facilitate connection of the first section and the second section of the support member: and an attachment assembly that is sized and configured to facilitate attachment of a component to the support member, the attachment assembly comprising:

a first bracket attached at least proximate the flared end of the first section;

a second bracket attached at least proximate the tapered end of the second section; and a second fastener configured to connect the first bracket and the second bracket.

2. The support member for playground equipment as in claim 1, wherein the first fastener is sized and configured to maintain the first section and the second section in a desired alignment when the first section and the second section are being connected.

3. The support member for playground equipment as in claim 1, wherein the first fastener is removed when the first section and the second section are connected and the flared end and the tapered end overlap the second amount;

wherein the opening in the flared end of the first section is enlarged; and wherein a third fastener with a larger diameter than the first fastener is inserted into the opening in the flared end of the first section and the opening in the tapered end of the second section.

4. The support member for playground equipment as in claim 1, wherein the first section and the second section form at least a portion of a generally horizontally disposed support member for the playground equipment.

5. The support member for playground equipment as in claim 1, wherein the first section and the second section form at least a portion of a generally vertically disposed support member that forms part of a support structure for the playground equipment.

6. The support member for playground equipment as in claim 1, wherein the attachment assembly further comprises a connector including a first end configured to be attached to the second fastener and a second end that is sized and configured to be attached to a tether of the component.

7. The support member for playground equipment as in claim 1, wherein the second fastener is disposed generally parallel to the first section and the second section when the first section is attached to the second section.

8. The support member for playground equipment as in claim 1, wherein the first bracket attached to the flared end of the first section includes a first opening that is sized and configured to receive an end of the second fastener and a second opening that is sized and configured to receive a nut that is configured to be connected to the end of the second fastener.

9. The support member for playground equipment as in claim 1, wherein the second bracket attached to the tapered end of the second section comprises:

a first flange extending generally perpendicular to the second section;

a second flange extending generally perpendicular to the second section; and a connector configured to be indirectly attached to the first flange and the second flange by the second fastener.

10. The support member for playground equipment as in claim 1, wherein tightening the second fastener draws the flared end of the first section and the tapered end of the second section closer together and into a greater overlapping relationship.

11. The support member for playground equipment as in claim 1, wherein the second fastener facilitates connection of the first section and the second section of the support member; and wherein the second fastener provides an attachment point for the component to the support member.

12. Playground equipment including the support member of claim 1, and the playground equipment further comprising:

a first support assembly configured to be connected to the support member; and a second support assembly configured to cooperate with the first support assembly to facilitate positioning of the support member above the ground.

13. Playground equipment according to claim 12, wherein the first support assembly is configured to be connected to the support member with one or more gussets.

14. Playground equipment according to claim 12, wherein the playground equipment comprises a swing set, and the playground equipment further comprises:

an additional attachment assembly according to claim 1; and a swing configured to be connected at least indirectly to the attachment assembly and the additional attachment assembly.

15. The playground equipment of claim 12, wherein the support member and support assemblies are at least partly disassembled and are contained in packaging.

16. The support member of claim 1, wherein the support member is at least partly disassembled and is contained in packaging.

17. A method of connecting a first section and a second section of a support member for playground equipment, the method comprising:

connecting a flared end of the first section with a tapered end of a second section a first amount, the first section including a first flange located proximate the flared end, and the second section including a second flange located proximate the tapered end;

aligning an opening in the flared end of the first section with an opening in the tapered end of the second section;

inserting a first fastener into the aligned openings in the flared end of the first section and the tapered end of the second section; and connecting the flared end of the first section with the tapered end of the second section a second amount;

connecting the first flange and the second flange by a second fastener;

wherein the first fastener helps maintain the first section and the second section in the desired position and helps prevent unintended rotational movement of the first section and the second section when the first section and the second section are connected the second amount; and wherein the second fastener provides an attachment point that is sized and configured to allow a component to be attached to the support member.

18. The method as in claim 17, further comprising:

removing the first fastener from the aligned openings in the flared end of the first section and the tapered end of the second section;

enlarging the portion of the openings that are aligned; and inserting a third fastener with a larger diameter than the first fastener into the aligned openings.

19. The method as in claim 17, wherein a swing is connected to the second fastener by a connector.

20. A method of connecting a first section and a second section of a support member for playground equipment and providing an attachment point for a component to be attached to the support member, the method comprising:

connecting a flared end of the first section with a tapered end of a second section a first amount;

connecting a first flange attached to the first section with a second flange attached to the second section with a fastener by performing the following;

inserting the fastener through an opening in the second flange;

inserting the fastener through an opening in a connector that is sized and configured to allow the component to be connected to the support member; and inserting the fastener through an opening in the first flange;

securing the fastener in place; and connecting the component to the support member by the fastener.

21. The method as in claim 20, wherein the first section and the second section are joined along an axis; and wherein the fastener is disposed generally parallel to the axis.

22. The method as in claim 20, further comprising attaching a tether at least indirectly to the fastener, the tether configured to support a swing.

* * * * *

UNITED STATES PATENT AND TRADEMARK OFFICE

CERTIFICATE OF CORRECTION

PATENT NO. : 8,079,915 B2
APPLICATION NO. : 12/506442
DATED : December 20, 2011
INVENTOR(S) : Spencer et al.

It is certified that error appears in the above-identified patent and that said Letters Patent is hereby corrected as shown below:

Column 3
Line 9, change “and that may” to --and may--

Column 4
Line 39, change “is support” to --is a support--

Column 9
Line 45, change “fastener by” to --fastener--
Line 67, change “flared 40” to --flared--

Column 10
Line 20, change “a one” to --one--

Signed and Sealed this
Fifteenth Day of May, 2012

David J. Kappos

David J. Kappos
*Director of the United States Patent and Trademark Office*